US007726500B2

(12) United States Patent
Young et al.

(10) Patent No.: US 7,726,500 B2
(45) Date of Patent: Jun. 1, 2010

(54) PLASTIC CONTAINER WITH SEPARATELY FORMED HANDLE

(75) Inventors: William C. Young, Ypsilanti, MI (US); Richard C. Darr, Medina, OH (US); Christopher E. Kaminski, North Royalton, OH (US)

(73) Assignee: Plastipak Packaging, Inc., Plymouth, MI (US)

( * ) Notice: Subject to any disclaimer, the term of this patent is extended or adjusted under 35 U.S.C. 154(b) by 0 days.

(21) Appl. No.: 11/895,345

(22) Filed: Aug. 24, 2007

(65) Prior Publication Data

US 2007/0289939 A1 Dec. 20, 2007

Related U.S. Application Data

(63) Continuation of application No. 11/403,482, filed on Apr. 13, 2006, now abandoned, which is a continuation-in-part of application No. 29/245,347, filed on Dec. 22, 2005, now Pat. No. Des. 543,463.

(51) Int. Cl.
*B65D 23/10* (2006.01)

(52) U.S. Cl. ..... 215/396; 215/398; 215/383

(58) Field of Classification Search ..... 215/396, 215/398, 383

See application file for complete search history.

(56) References Cited

U.S. PATENT DOCUMENTS

| | | | | | |
|---|---|---|---|---|---|
| D146,128 | S | * | 12/1946 | Billups | D9/528 |
| D221,515 | S | * | 8/1971 | Betka | D9/531 |
| 4,964,522 | A | * | 10/1990 | Umetsu et al. | 215/398 |
| D355,367 | S | * | 2/1995 | Rokus | D9/531 |
| 5,469,612 | A | * | 11/1995 | Collette et al. | 29/453 |
| 5,533,881 | A | * | 7/1996 | Collette et al. | 425/525 |
| 5,560,506 | A | * | 10/1996 | Yanagisawa et al. | 215/398 |
| 5,988,418 | A | * | 11/1999 | Maeshima | 215/396 |
| 6,460,715 | B1 | * | 10/2002 | Yonemori et al. | 215/396 |
| D480,973 | S | * | 10/2003 | Nottingham et al. | D9/531 |
| D511,101 | S | * | 11/2005 | Nottingham et al. | D9/531 |
| D549,584 | S | * | 8/2007 | Gruskin et al. | D9/531 |

FOREIGN PATENT DOCUMENTS

| | | | |
|---|---|---|---|
| JP | 9-12032 | * | 1/1997 |
| JP | 9-39973 | * | 2/1997 |
| JP | 2000-177740 | * | 6/2000 |

* cited by examiner

*Primary Examiner*—Tri M Mai
(74) *Attorney, Agent, or Firm*—Dykema Gossett PLLC

(57) ABSTRACT

A hollow plastic container with a separately formed handle engaging the sidewall of the container and supported thereby. The handle includes an elongated portion extending upwardly over the major portion of the longitudinal extent of the sidewall and arm portions extending from the elongated portion towards the sidewall for engagement with the sidewall, wherein the sidewall receives the arm portions and holds the handle in place.

20 Claims, 3 Drawing Sheets

PLASTIC CONTAINER WITH SEPARATELY FORMED HANDLE

CROSS-REFERENCE TO RELATED APPLICATIONS

This application is a continuation of U.S. patent application Ser. No. 11/403,482, filed Apr. 13, 2006, now abandoned which in turn is a continuation-in-part of U.S. patent application Ser. No. 29/245,347, filed Dec. 22, 2005, now U.S. Pat. D543,463, issued May 29, 2007.

BACKGROUND OF THE INVENTION

Plastic containers are widely used commercially for a variety of products. These containers often include handles for easy dispensing of product. The handles are generally integrally formed with the container, as by a stretch blow molding procedure, which is well known. Also, often the handles generally extend outwardly from the container.

However, the integral handle configuration complicates the stretch blow molding process. It would be highly desirable to provide a container configuration which can be formed without an integral handle, and separately form a handle for subsequent attachment to the container. Particularly, it would be desirable to provide such a separately formed handle which does not extend outwardly from the container since an outwardly extending handle would be subject to damage in processing and handling. Moreover, the foregoing should be accomplished in a simple and convenient way with a firm engagement between the separately formed handle component and the separately formed container component. The resulting product should be esthetically pleasing and easy to use by the consumer.

It would be particularly desirable to provide such a container-handle configuration wherein the handle is easily engagable with the container, and wherein the handle can be easily removed and re-engaged if desired.

In addition, it is desirable to provide a lightweight, plastic container suitable for preparation by stretch blow molding and which permits rigidity while handling and pouring, together with a firm, rigid separately formed handle component.

Accordingly, it is an objective of the present invention to provide an improved plastic container with a separately formed handle, wherein the container portion can be conveniently prepared by stretch blow molding.

It is a further objective of the present invention to provide a container as aforesaid wherein the separately formed handle can be firmly engaged with the container, and is removable from the container, if desired, and is easy to use by the consumer.

It is a still further objective of the present invention to provide a container as aforesaid which is lightweight; and wherein the container with engaged handle has good product characteristics.

Further objects and advantages of the present invention will appear hereinbelow.

SUMMARY OF THE INVENTION

In accordance with the present invention the foregoing objects and advantages are readily obtained.

The plastic container of the present invention, including a separately formed handle, comprises: a hollow body of plastic material having a lower supporting base, a sidewall extending upwardly from the base, and an upper neck portion with an opening therein, said neck portion extending upwardly from the sidewall; a separately formed handle engaging said sidewall and supported thereby, said handle having an elongated portion extending upwardly over the major portion of the longitudinal extent of the sidewall, and arm portions extending from the elongated portion towards the sidewall for engagement with the sidewall; and means on the sidewall to receive said arm portions and hold said handle in place.

The container preferably includes a shoulder portion extending upwardly and preferably inwardly from the sidewall between the neck portion and the sidewall. The elongated portion of the handle preferably extends in a substantially straight line along the sidewall, and the arm portions preferably extend from the ends of the elongated portion. The elongated portion desirably extends upwardly over at least 75 percent of the longitudinal extent of the sidewall. This provides an elongated handle for a firm and secure grip.

The sidewall preferably includes a recessed portion to receive the handle, with an open space beneath the elongated portion for a positive grip. The arm portions include enlarged portions on the end thereof which engage the sidewall recessed portion. The enlarged portions desirable include hook-like protrusions which seat in depressions in the sidewall.

The handle desirably extends solely along the sidewall and the elongated portion of the handle is substantially flush with the outer extent of the sidewall. Moreover, advantageously, the separately formed handle is removable if desired.

Further features of the present invention will appear hereinbelow.

BRIEF DESCRIPTION OF THE DRAWINGS

The present invention will be more readily understandable from a consideration of the following illustrative drawings, wherein.

DETAILED DESCRIPTION OF PREFERRED EMBODIMENTS

Figure 2:
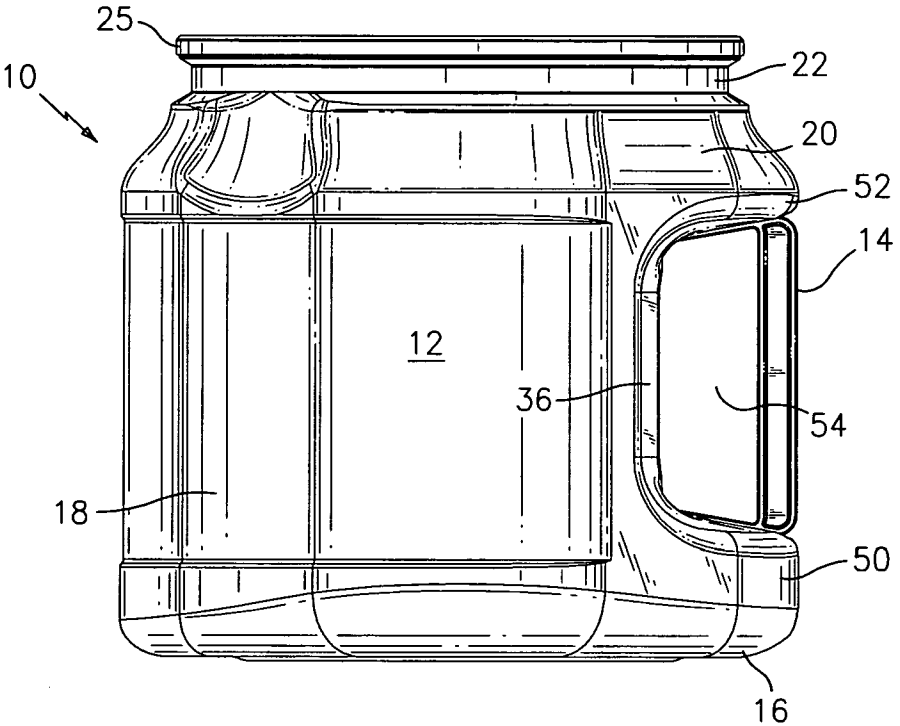
FIG. 2 is a side elevation view thereof showing the left side.
Figure 1:
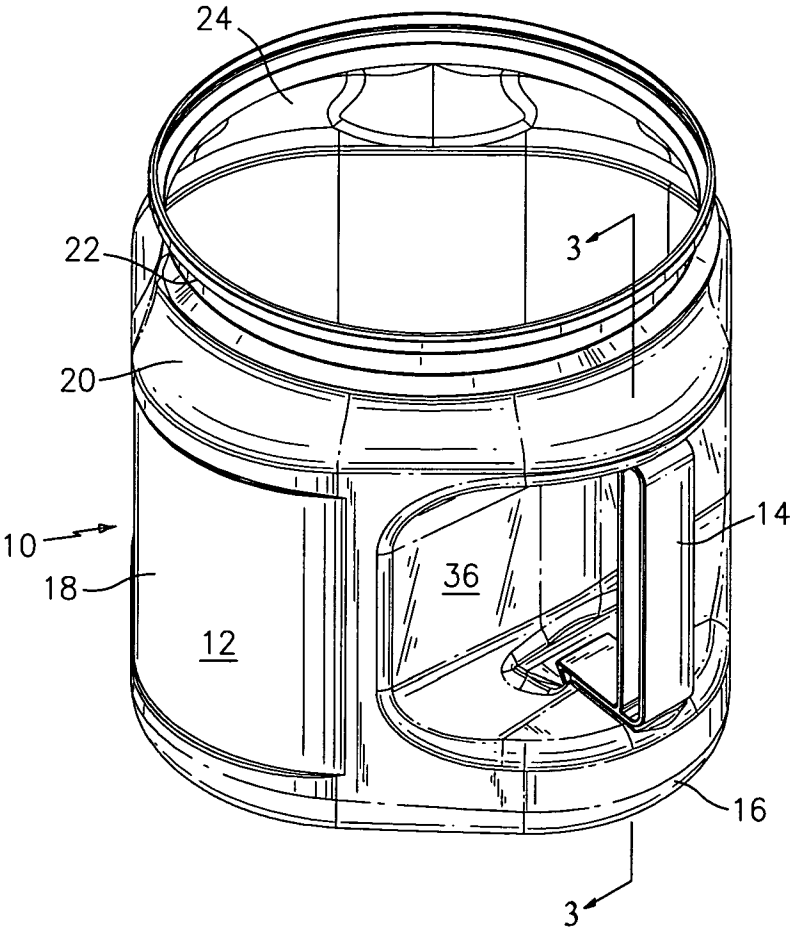
FIG. 1 is a perspective view of one embodiment of the plastic container of the present invention including separately formed handle attached thereto showing the front, left side and top thereof.

Referring to the drawings, FIGS. 1 and 2 show one embodiment of the plastic container 10 of the present invention with container portion 12 and the separately formed handle 14 attached thereto.

The container 10 is a hollow, blow molded plastic container having a lower supporting base 16, a sidewall 18 extending upwardly from the base 16, a gradually inclined shoulder portion 20 extending upwardly from the sidewall, and an upper neck portion 22 with an opening 24 therein to the inside of the container extending upwardly from the shoulder portion 20.

The containers of the present invention are preferably made of a pliable, deformable synthetic plastic material, such as for example, polyethylene, polypropylene, or polyethylene terephthalate (PET), or other plastic material, although PET is generally used. The specific embodiment shown in the drawings is for a 48 oz. plastic container, as for powdered coffee or any other desired product. However, the present invention can be effectively employed for any plastic container where a handle is desirably employed.

The particular neck portion 22 shown in FIGS. 1-2 includes an upper flange portion 25 for a snap-on closure and/or a foil closure (not shown). However, other type neck finishes can be readily employed, as a threaded section to accommodate a screw-on closure. In addition, the embodiment shown provides an essentially round opening 24 to the inside of the container, but other opening shapes may be used if desired. Also, the outer extent of the upper neck portion in the embodiment shown extends inwardly of the sidewall, which is preferred.

Figure 5:
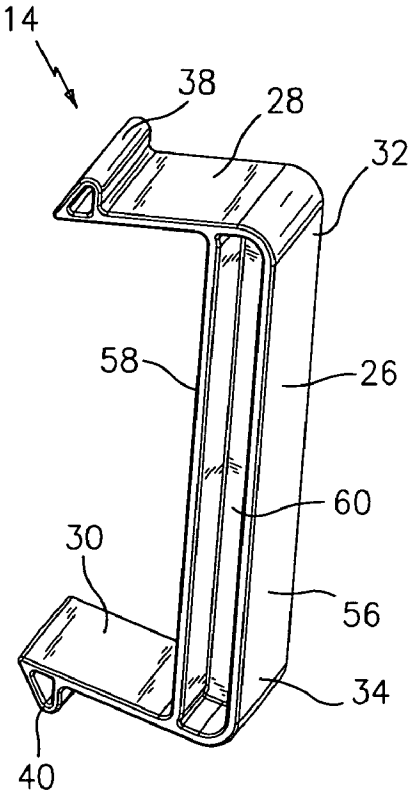
FIG. 5 is a perspective view of the separately formed handle showing one side, the outside of the elongated portion and the arm portions.
Figure 4:
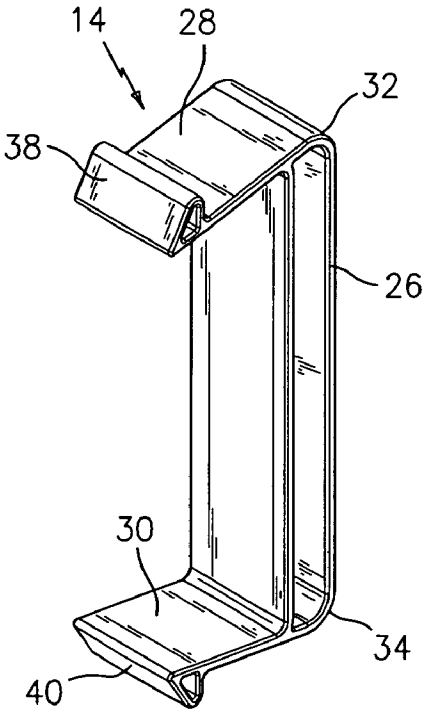
FIG. 4 is a perspective view of the separately formed handle showing one side, the inside of the elongated portion and the arm portions.
Figure 3:
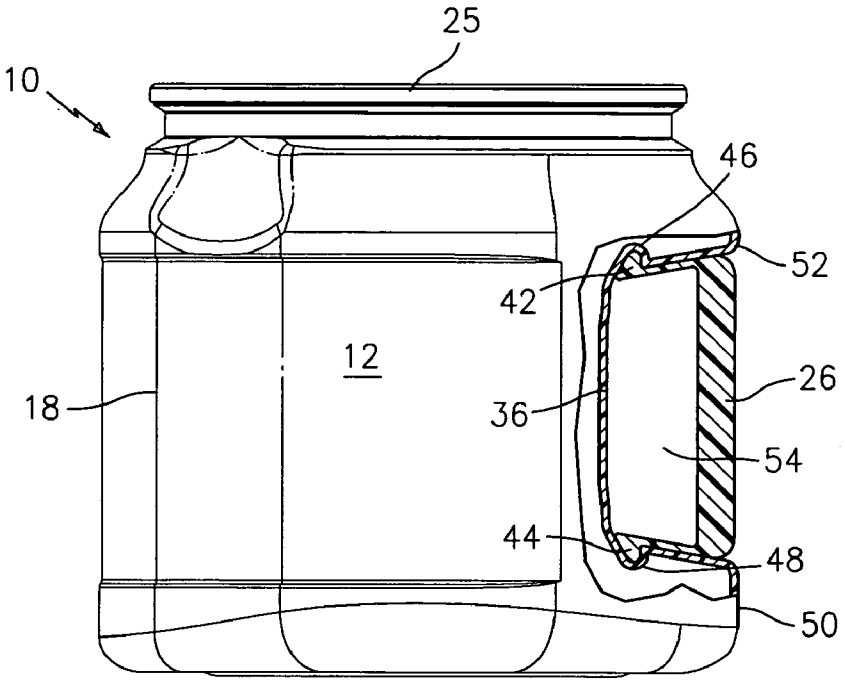
FIG. 3 is a partially broken away side elevation view thereof.

FIGS. 4 and 5 show perspective views of the separately formed handle 14, and FIG. 3 shows a side elevation view of the container with attached handle and with the handle portion and portions of the container partially broken away.

The separately formed handle 14 has an elongated portion 26 extending upwardly thereon and upper and lower arm portions 28 and 30, respectively, extending inwardly from the upper and lower ends 32 and 34, respectively, from the elongated portion. The handle is desirably a one-piece handle. Container sidewall 18 includes a recessed portion 36 to receive handle 14. The handle arm portions 28, 30 extend towards the container and seat in the recessed portion 36. The handle arm portions may extend at a slight angle or generally perpendicular with respect to the elongated portion 26. The handle arm portions 28, 30 each include enlarged portions 38, 40 on the ends thereof which engage the sidewall recessed portion 36, preferably including hook-like protrusions 42, 44 which seat in depressions 46, 48 in the sidewall recessed portion. The handle 14 can, therefore, be readily inserted and firmly held in place. In addition, if desired, the handle can be easily removed. Naturally, other handle-container engagement means can be readily provided.

When handle 14 is fixed in place on the container sidewall 18 the handle elongated portion 26 extends upwardly over the major portion of the longitudinal extent of the sidewall, extending upwardly over at least 75 percent of the longitudinal extent of the sidewall. Elongated handle portion 26 preferably extends in a substantially straight line along the sidewall 18. The container sidewall 18 includes a lower portion 50 thereof below handle 14 and an upper portion thereof 52 above handle 14, so that the handle conveniently extends solely along sidewall 18. Moreover, as can be seen, the elongated handle portion 26 is substantially flush with the outer extent of the sidewall. In addition, the container sidewall recessed portion 36 forms an open space 54 beneath handle 14 for convenience and ease of grasping the handle.

The handle 14 elongated portion 26 may be solid or may have an outer portion 56 and an inner portion 58 joined by central portion 60, as clearly shown in FIG. 5. Alternatively, if desired, the elongated handle portion 26 may simply be a strip-like portion.

Figure 6:
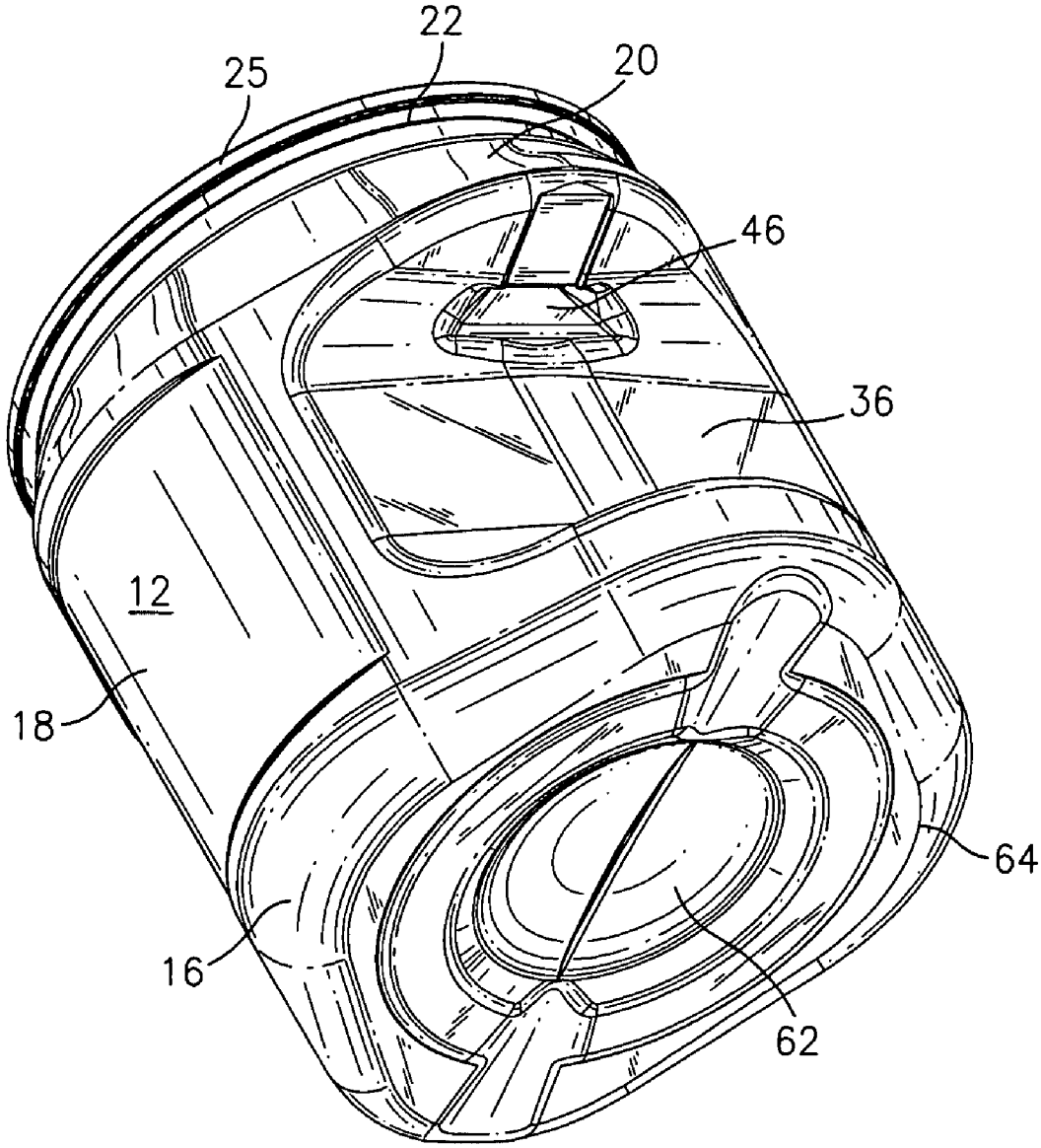
FIG. 6 is a perspective view of the plastic container of the present invention without the separately formed handle showing front, left side and bottom thereof.

An exemplificative base 16 is shown in FIG. 6, which shows a perspective view of the container portion 12 without the handle attached. Base 16 has a central, inwardly extending recessed area 62 and a peripheral rim 64, which makes the container suitable for stacking. The outer extent of container base 16 is essentially square with rounded corners. Naturally, other base configurations may be conveniently employed.

Naturally, variations within the scope of the present invention are contemplated herein. For example, one may alter the handle or container configuration, and rib reinforcement modifications may be added to the sidewall to facilitate handling performance for particular applications.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A plastic container with a separately formed handle, which comprises:

a hollow body of plastic material having a lower supporting base, a sidewall extending upwardly from the base, and an upper neck portion with an opening therein, said neck portion extending upwardly from the sidewall;

a separately formed handle engaging said sidewall and supported thereby, said handle having an upper end, a lower end, and an elongated portion extending upwardly over the major portion of the longitudinal extent of the sidewall over at least 75% of the longitudinal extent of the sidewall, and two separate arm portions spaced from each other and extending from the elongated portion towards the sidewall for engagement with the sidewall; and means on the sidewall to receive said arm portions and hold said handle in place, wherein said sidewall includes a recessed portion to receive said handle; both of said arm portions extend towards each other and towards the container, with each arm portion including enlarged portions adjacent the end thereof which engage the sidewall recessed portion; each arm portion has a length which terminates at the enlarged portion; and, when the sidewall receives said handle, the elongated portion of the handle is substantially flush with the outer extent of the sidewall and the upper end of the handle does not extend radially outwardly beyond a portion of the sidewall located vertically above the upper end.

2. A plastic container according to claim 1, wherein said elongated portion extends in a substantially straight line along said sidewall.

3. A plastic container according to claim 1, wherein said arm portions extend from the ends of the elongated portion.

4. A plastic container according to claim 1, wherein said handle is a one-piece handle.

5. A plastic container according to claim 1, including a shoulder portion extending upwardly from the sidewall between the neck portion and the sidewall.

6. A plastic container according to claim 5, wherein said shoulder portion extends inwardly between the neck portion and the sidewall.

7. A plastic container according to claim 1, wherein said enlarged portions comprise hook-like protrusions which seat in depressions in said sidewall recessed portion.

8. A plastic container according to claim 1, wherein the outer extent of said upper neck portion extends inwardly of said sidewall.

9. A plastic container according to claim 8, wherein the container opening is essentially round.

10. A plastic container according to claim 9, wherein the outer extent of said container base is essentially square with rounded corners.

11. A plastic container according to claim 1, wherein said sidewall extends upwardly above said handle and downwardly below said handle.

12. A plastic container according to claim 1, wherein said handle extends solely along said sidewall.

13. A plastic container according to claim 1, wherein said separately formed handle is removable.

14. A plastic container according to claim 1, wherein the elongated portion of the handle includes an outer portion and an inner portion, the outer and inner portions being joined by a central portion.

15. A plastic container according to claim 1, wherein said recessed portion forms an open space beneath the handle elongated portion.

16. A plastic container according to claim 1, wherein said means on the sidewall to receive said arm portions include wall portions oriented at an angle towards the elongated portion of said handle to engage said arm portions.

17. A plastic container according to claim 1, wherein the plastic container has a total vertical height extending from the bottom of the lower supporting base to the top of the neck portion that is less than the greatest horizontal width or diameter of the plastic container.

18. A plastic container according to claim 1, wherein when the sidewall receives said handle, the lower end of the handle does not extend radially outwardly beyond a portion of the sidewall located vertically below the lower end.

19. A plastic container with a separately formed handle, which comprises:

a hollow body of plastic material having a lower supporting base, a sidewall extending upwardly from the base, and an upper neck portion with an opening therein, said neck portion extending upwardly from the sidewall; and a separately formed handle engaging said sidewall and supported thereby, said handle having an upper end, a lower end, and an elongated portion extending upwardly over the major portion of the longitudinal extent of the sidewall over at least 75% of the longitudinal extent of the sidewall, and two separate arm portions spaced from each other and extending from the elongated portion towards the sidewall for engagement with the sidewall;

wherein said sidewall includes a recessed portion to receive said handle and the recessed portion includes depressions configured to receive said arm portions and hold said handle in place; both of said arm portions extend towards each other and towards the container, with each arm portion including enlarged portions adjacent the end thereof which engage the sidewall recessed portion; each arm portion has a length which terminates at the enlarged portion; when the sidewall receives said handle, the elongated portion of the handle is substantially flush with the outer extent of the sidewall, the upper end of the handle does not extend radially outwardly beyond a portion of the sidewall located vertically above the upper end, and the lower end of the handle does not extend radially outwardly beyond a portion of the sidewall located vertically below the lower end; and the plastic container has a total vertical height extending from the bottom of the lower supporting base to the top of the neck portion that is less than the greatest horizontal width or diameter of the plastic container.

20. A plastic container according to claim 19, wherein the outer extent of said container base is essentially square with rounded corners.

* * * * *